United States Patent [19]

Bixel et al.

[11] Patent Number: 4,778,482

[45] Date of Patent: Oct. 18, 1988

[54] DRYING LOW RANK COAL AND RETARDING SPONTANEOUS IGNITION

[75] Inventors: John C. Bixel, Washington Crossing, Pa.; Michael J. Dabkowski, Mickleton, N.J.

[73] Assignee: Mobil Oil Corporation, New York, N.Y.

[21] Appl. No.: 70,649

[22] Filed: Jul. 6, 1987

Related U.S. Application Data

[63] Continuation of Ser. No. 810,116, Dec. 18, 1985, abandoned, which is a continuation-in-part of Ser. No. 798,513, Nov. 15, 1985, abandoned.

[51] Int. Cl.[4] ..... C10L 5/00

[52] U.S. Cl. ..... 44/501

[58] Field of Search ..... 44/1 R, 1 G, 6, 501

[56] References Cited

U.S. PATENT DOCUMENTS

| | | | |
|---|---|---|---|
| 4,201,657 | 5/1980 | Anderson et al. | 44/6 |
| 4,265,637 | 5/1981 | Anderson | 44/6 |
| 4,396,394 | 8/1983 | Li et al. | 44/1 G |
| 4,402,707 | 9/1983 | Wunderlich | 44/6 |
| 4,524,227 | 6/1985 | Fowles et al. | 585/408 |

*Primary Examiner*—Carl F. Dees

*Attorney, Agent, or Firm*—Alexander J. McKillop; Michael G. Gilman; Van D. Harrison, Jr.

[57] ABSTRACT

Coal is rendered less subject to abrasion and disintegration by reducing it to a 0.2 to 0.5-inch particle size and drying it at a temperature of 200° to 230° F. for 3–7 minutes. The coal can be rendered less susceptible to spontaneous ignition by the application of a treating agent which can be a light cycle oil, heavy cycle oil, clarified slurry oil, a petroleum or coal derived distillate or residuum, a solution of durene in gasoline and mixtures of two or more of the preceding.

6 Claims, No Drawings

DRYING LOW RANK COAL AND RETARDING SPONTANEOUS IGNITION

CROSS-REFERENCE TO RELATED APPLICATIONS

This is a continuation of copending application Ser. No. 810,116, filed on Dec. 18, 1985, now abandoned, which is a continuation-in-part of our copending application Ser. No. 798,513, filed Nov. 15, 1985 (now abandoned), which is incorporated herein by reference.

NATURE OF THE INVENTION

This invention relates to improved methods for producing a dried particulate coal fuel having a reduced tendency to ignite spontaneously. More specifically, it relates to a method for drying coal, particularly low rank coals, and rendering them less susceptible to spontaneous ignition.

BACKGROUND OF THE INVENTION

Although low sulfur, sub-bituminous coal is readily available it may have such a high moisture content and low heating value that it is of little use as a fuel in existing boilers. Thermal drying to reduce the moisture content of the coal can upgrade its heating value to a point where the dried coal can compete favorably with many bituminous coals. With a low sulfur content such coal can meet clean air requirements for many power plants and make a major contribution to reducing sulfur dioxide emissions and acid rain. The drying required with such low rank coals is a deep drying process to remove both surface water and large quantities of interstitial water present. The handling, storage and transportion of such deep dried coal can present technical problems resulting from the friability and dustiness of the coal, as well as its tendency to readsorb moisture and react with oxygen from the air. Spontaneous combustion can result from heats of moisture readsorption and oxidation. Removing moisture inherent in the coal structure can also reduce the strength of the coal particle by cracking or fissuring, causing friability and dusting. The number of active surface sites exposed within the coal particles can also thus be increased, thereby increasing undesired moisture adsorption and oxidation.

Drying conditions such as temperature, residence time within the drying chamber, drying gas velocities, etc., affect the tendencies of the dried coal product to exhibit the undesirable qualities discussed above. For example, rapid removal of moisture by a high drying temperature can cause what is commonly called "the popcorn effect"—the fissuring and cracking and disintegration of the coal particles. Drying the coal and removing the moisture at a slower rate can reduce this effect—preventing disintegration and allowing moisture to escape in a manner that reduces cracking and fissuring. Smaller fissures make the coal particles more amenable to surface treatment agents which block the pores or coat the particle uniformly and act as effect oxidation or moisture readsorption inhibitors. However, slower drying rates necessitate longer residence times in the drying chamber to achieve the same degree of moisture removal. Because of the turbulent action in a fluidized drying bed, longer residence time leads to increased mechanical size-degradation of the coal particles, increasing dust in the dried product.

SUMMARY OF THE INVENTION

Briefly stated, this invention comprises drying particulated sub-bituminous or lignitic coal under specified conditions of temperature and residence time in the dryer which have been discovered to be optimum for this process. Optionally, but preferably, thereafter the dried particulated coal is coated or contacted with a liquid treating agent thereby reducing its tendency to adsorb moisture and/or to spontaneously ignite. The treating agent is a heavy cycle or light cycle oil, a mixture of these cycle oils, and/or a clarified slurry oil derived in the refining of petroleum hydrocarbons. Preferably the mixtures contain heavy cycle oil in a proportion of between 0 to 90 volumes of heavy cycle oil, 0 to 50 volumes of light cycle oil and/or 0 to 100 volumes of clarified slurry oil. A mixture containing a ratio of 2 volumes of heavy cycle oil to 1 volume of light cycle oil is most particularly preferred. The treating agent can also be a distillate or residuum from the liquefaction of coal, a petroleum resid, or a solution of durene in gasoline, diesel or other hydrocarbon liquids derived from the conversion of methanol to liquid hydrocarbon fuels.

DETAILED DESCRIPTION OF THE INVENTION

This invention is an improved method of reducing the tendency of dried particulated coal to disintegrate and ignite spontaneously. Coals may be dried to remove surface water or deep dried to remove interstitial water and thereby increase the heating value of the coal. In this description dried coal is coal that has been dried to remove some of the interstitial water and the moisture content of a dried coal as measured in accordance with the procedures set forth in ASTM D3173-73 entitled "Standard Test Method For Moisture in the Analysis Sample of Coal and Coke" published in the 1978 Annual Book of ASTM Standards, Part 26. Techniques for drying coal are discussed in U.S. Pat. Nos. 4,396,394 and 4,402,707 both of which are incorporated herein by reference. The method of this invention is applicable to all forms of dried coal, especially deep dried coal, but is especially useful for dried low rank coals such as sub-bituminous, lignite and brown coals.

In the method of this invention, the coal particles are first reduced to particles having a maximum diameter of 1 to 4 inches with an average diameter of about 0.2 to 0.5 inches. The particulated coal is then contacted with a heated stream of drying gas, preferably in a fluidized bed, at a temperature between about 190° F. and 230° F., (preferably 200° F. to 215° F.) for a contact period of between 1 and 15 minutes (preferably 3 to 7 minutes) so that the rate of evaporation of water is about 0.1 to 0.5 tons per hour (preferably 0.17 to 0.22 tons per hour) per ton of raw coal. The techniques for drying the particulated coal are set forth in the U.S. Pat. Nos. 4,396,394 and 4,402,707 noted previously. The dried particulated coal is then sprayed with a deactivating oil composition which is a heavy or light cycle oil, a mixture of these, a slurry oil or combinations thereof derived from the petroleum refining process. Cycle oil is the predominantly aromatic fraction obtained from the catalytic cracking of petroleum fraction and having a boiling range of 400° F. to 900° F. Heavy cycle oil is that portion of cycle oil boiling between 700° F. and 900° F. Light cycle oil is that portion of cycle oil boiling between 400° F. and 700° F. Clarified slurry oil is the highly aromatic fraction from catalytic cracking which boils above 900° F. In addition, hydrocarbon oils derived from the liquefaction of coal, either raw or upgraded, are suitable deactivating agents.

Preferably the oil has a characterization factor of between 10 and 11. The characterization factor is a special physical property of hydrocarbons defined by the relationship:

$$K = \frac{T_b^{\frac{1}{3}}}{G}$$

where

K=Characterization factor $T_b$=Cubic average boiling point °R.

G=Specific gravity 60° F./60° F.

*R=°F.+460.

The cubic average boiling point is determined in accordance with the calculations mentioned in an article entitled "Boiling Points and Critical Properties of Hydrocarbon Mixtures," by R. L. Smith and K. M. Watson, appearing in industrial and Engineering Chemistry, Volume 29, pages 1408–1414, December, 1937, and using the ten, thirty, fifty, seventy, and ninety percent points °F. as measured by the procedures of ASTM D1160-77, previously described or ASTM D86 entitled "Standard Method for Distillation of Petroleum Products", published in the 1978 Annual Book of ASTM Standards, Part 23. ASTM D86 is for products which decompose when distilled at atmospheric pressure.

Accordingly, in the method of this invention after the dried coal particles have been removed from the drying system they are contacted with the liquid treating agent of this invention by spraying or by other means of applying a thin coating. The liquid treating agent of this invention can be used in any desired quantity, but between 0.2 and 5 gallons of liquid per ton of dried coal will ordinarily be adequate. The preferred range is between 0.5 and 2 gallons of oil per ton of dried coal.

EXAMPLES

The drying process of this invention was evaluated in a number of field tests. These tests also incorporated application of treating agents to the coal after it was dried. In each test drying conditions were chosen to dry the coal below 10 wt.% moisture. The drying conditions for three runs are shown in Table 1. Tests to determine dustiness, tendency for spontaneous ignition and tendency for moisture readsorption were conducted.

From the test results shown in Table 2 it is apparent that the use of the conditions set forth under "B" results in a dried, particulate coal which is reduced in size a minimum amount during the drying step. The data given in Table 2 is for particles untrated by an inactivating agent. After the drying operation the dried sampled were then treated by being sprayed with the various liquids shown in Table 3.

Evaluation of the results indicate that a treating agent of a particular composition ($\frac{2}{3}$ heavy cycle oil, $\frac{1}{3}$ light cycle oil), when applied to the dried coal was particularly effective in inhibiting spontaneous ignition under the test conditions used. Visual observations of the treated samples indicated a reduction of dust after application of the inactivating agents.

Table 3 shows the results of testing of various ratios of cycle oil on a low sulfur, sub-bituminous coal as far as the reduction in the combustibility of the coal. The coal tested was one which had been dried to below 10 wt.% moisture. The results shown in column A are for a coal having an average particle size of 0.147", in column B, a particle size of 0.17" and in column C, a particle size of 0.169. In each test the particles were coated with the particular treating agent shown and were then tested for spontaneous ignition. Columns A, B and C indicate the respective ignition times determined. It will be noted that in one of the better runs, Example 4, there was no ignition achieved with one of the examples wherein the volumetric ratio of heavy to light cycle oil was 2:1.

TABLE 1

DRYING CONDITIONS

| | A | B | C |
|---|---|---|---|
| Residence Time, Minutes | 3 | 5 | 7 |
| Feed Rate, Tons of Coal per hour | 2.09 | 2.02 | 1.77 |
| Dryer Bed Temperature, °F. | 230 | 215 | 200 |
| Evaporation Rate, Tons per hour of water | 0.45 | 0.41 | 0.30 |

TABLE 2

EFFECT OF DRYER CONDITIONS ON PRODUCT PARTICLE SIZE

| Condition (see Table 1) | Average Particle Size (Inches) Feed | Product | Size Degradation (%) |
|---|---|---|---|
| A | 0.3049 | 0.147 | 51.8 |
| B | 0.3058 | 0.170 | 44.4 |
| C | 0.3112 | 0.169 | 45.7 |

TABLE 3

EFFECT OF LIQUID INACTIVATING COMPOSITIONS ON SPONTANEOUS IGNITION

| Examples | Treatment | Additive | Gal/ton | Ignition Time, Hours A | B (See Table 1) | C |
|---|---|---|---|---|---|---|
| 1 | Hvy cat cycle oil | None | 1.0 | 8 | 5 | |
| 2 | Hvy cat cycle oil | None | 2.0 | 7 | 4 | |
| 3 | Mix of cat oils 2:1 | None | 1.0 | 4 | 6 | |
| 4 | Mix of cat oils 2:1 | None | 2.0 | 5 | No burning | |
| 5 | Mix of cat oils 1:1 | None | 1.0 | 3 | 4 | 4 |
| 6 | Mix of cat oils 1:1 | None | 2.0 | 4 | 7 | 6 |
| Average Time, hrs. | | | | 4.37 | 4.64 | 5.00 |

In addition to the cycle oil combinations of this invention it is also possible to use coal or petroleum-derived distillates or residuums, or a mixture of gasoline and durene resulting from the conversion of synthesis gas to Fischer-Tropsch products and the subsequent conversion of these products from the Fischer-Tropsch process into gasoline by contacting them with a zeolite of the ZSM-5 type. Similarly methanol is converted also to a mixture of gasoline and durene by contacting it with a ZSM-5 catalyst. These processes are set forth in U.S. Pat. Nos. 4,524,231; 4,524,228; 4,524,227, all of which are incorporated herein by reference. The gasoline-durene mixture available in the processes described therein will range from 10 to 30 percent concentration of durene.

What is claimed is:

1. A method for producing a dried particulate coal fuel comprising:

(a) reducing raw coal feedstock to a particle size having an average diameter of about 0.2 to about 0.5 inches;

(b) drying the resultant particulated raw coal to a moisture content of less than about 10 percent by weight by contacting it with a stream of drying gas; and (c) spraying and intimately mixing said dried coal with a deactivating composition comprising a solution of between about 10 and about 30 percent by weight of durene in gasoline.

2. A method for producing a dried particulate coal fuel comprising:

(a) reducing raw coal feedstock to a particle size having an average diameter of about 0.2 to about 0.5 inches;

(b) drying the resultant particulated raw coal to a moisture content of less than about 10 percent by weight by contacting it with a stream of drying gas; and (c) spraying and intimately mixing said dried coal with a deactivating composition having a K value of between about 10 and about 11, comprising a solution of between about 10 and about 30 percent by weight of durene in gasoline, the ratio of deactivating composition to coal being between about 0.2 and about 5 gallons per ton of coal.

3. A method for producing a dried particulate coal fuel comprising:

(a) reducing raw coal feedstock to a particle size having an average diameter of about 0.2 to about 0.5 inches;

(b) drying the resultant particulated raw coal to a moisture content of less than about 10 percent by weight by contacting it with a stream of drying gas; and (c) spraying and intimately mixing said dried coal with a deactivating composition having a K value of between about 10 and about 22, comprising a solution of between about 10 and about 30 percent by weight of durene in gasoline, the ratio of deactivating composition to coal being between about 0.2 and about 5 gallons per ton of coal.

4. The method of claim 1 wherein said coal is selected from the group consisting of sub-bituminous, lignite, brown coals and combinations thereof.

5. The method of claim 1 wherein said dried coal is sprayed with between about 0.2 and about 5 gallons of deactivating composition per ton of coal.

6. The method of claim 1 wherein said dried coal is sprayed with between about 0.5 and about 2 gallons of deactivating agent per ton of coal.

* * * * *